United States Patent [19]

Sekozawa et al.

[11] Patent Number: 4,939,658

[45] Date of Patent: Jul. 3, 1990

[54] CONTROL METHOD FOR A FUEL INJECTION ENGINE

[75] Inventors: Teruji Sekozawa, Kawasaki; Makoto Shioya, Tokyo; Motohisa Funabashi, Sagamihara; Mikihiko Onari, Kokubunji; Masami Shida, Mito, all of Japan

[73] Assignee: Hitachi, Ltd., Tokyo, Japan

[21] Appl. No.: 235,809

[22] Filed: Aug. 19, 1988

Related U.S. Application Data

[63] Continuation of Ser. No. 142,334, Dec. 29, 1987, abandoned, which is a continuation of Ser. No. 782,535, Oct. 1, 1985, abandoned.

[30] Foreign Application Priority Data

Sep. 3, 1984 [JP] Japan ..... 59-182628
Nov. 26, 1984 [JP] Japan ..... 59-248127

[51] Int. Cl.[5] ..... F02D 41/26; F02D 41/34

[52] U.S. Cl. ..... 364/431.06; 123/480; 123/489; 364/431.05

[58] Field of Search ..... 364/431.05, 431.06, 364/431.03, 431.04; 123/478, 480, 489, 492, 491, 493

[56] References Cited

U.S. PATENT DOCUMENTS 4,357,923 11/1982 Hideg ..... 123/492
4,388,906 6/1983 Sugiyama et al. ..... 123/492
4,481,928 11/1984 Takimoto et al. ..... 123/492

FOREIGN PATENT DOCUMENTS 152019 8/1985 European Pat. Off. .
59-3136 1/1984 Japan .

OTHER PUBLICATIONS

Tanaka et al.; Transient response of a Carburetor Engine Society of Automotive Engineers, paper, 770046, Feb. Mar. 1977.

Hires et al.; Transient Mixture Strength Excursions–An Investigation of their Causes and the Development of a Constant Mixture Strength Fueling Strategy, Soc. of Automotive Eng., paper 810495, 1981.

Aquino: Transient A/F Control Characteristics of the 5 Liter Control Fuel Injection Engine, Soc. of Automotive Engineers, paper #810494, 1981.

*Primary Examiner*—Felix D. Gruber
*Attorney, Agent, or Firm*—Antonelli, Terry, Stout & Kraus

[57] ABSTRACT

The fuel injection quantity required for maintaining the air-fuel ratio of the mixture supplied to each cylinder of an engine at a desired value is determined by a deposition rate X at which injected fuel deposits and forms a film mass on an intake manifold wall of the engine and a vaporization rate $1/\tau$ at which the film mass vaporizes from the manifold wall, a current film mass quantity $M_f$ determined from the calculated X and $1/\tau$ and the fuel quantity by the preceding injection, a desired fuel quantity $Q_a/(A/F)$ to be supplied air-fuel ratio A/F in accordance with the following equation $$G_f = \frac{Q_a/(A/F) - \frac{1}{\tau} M_f}{1 - X}$$

an air-fuel ratio feedback correction factor $\gamma$ aiming at a stoichiometric air-fuel ratio based on a signal generated by an $O_2$ sensor is calculated and an actual quantity of fuel corresponding to $G_f \cdot \gamma$ is injected. A film mass quantity in a current computing cycle is based on the film mass quantity calculated during the previous computing cycle.

12 Claims, 5 Drawing Sheets

FIG. 4
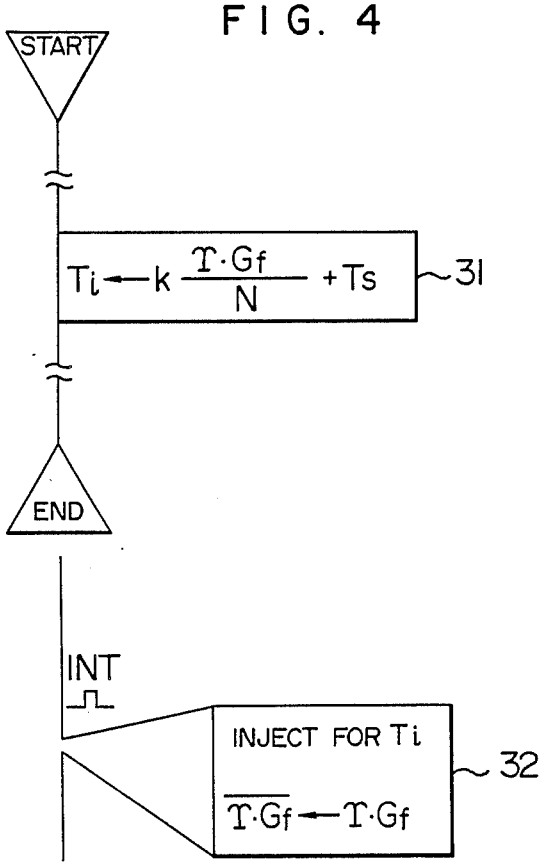
FIG. 5A
FIG. 5B
FIG. 5C
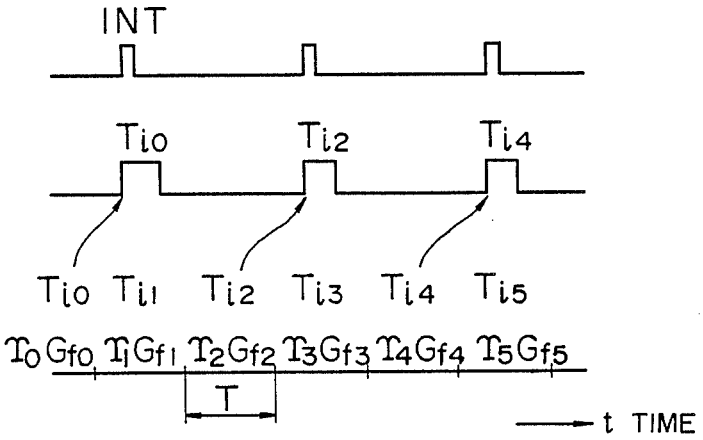

CONTROL METHOD FOR A FUEL INJECTION ENGINE

This application is a Continuation of application Ser. No. 142,334, filed Dec. 29, 1987 now abandoned which in turn is a continuation, of application Ser. No. 782,535, filed Oct. 1, 1985 and now abandoned.

BACKGROUND OF THE INVENTION

The present invention relates to a control method for fuel injection engines of the type used in vehicles such as automobiles and more particularly to a fuel injection control method so designed that the film mass deposited on the wall of the intake manifold is estimated and the desired fuel injection quantity is determined on the basis of the estimated film mass.

The fuel injected from the fuel injection valve is partly deposited on the intake manifold wall or the fuel deposited as the film mass is vaporized and fed into each cylinder thus failing to wholly supply the injected fuel into the cylinder and in particular the quantity of fuel supplied to the engine deviates considerably from the fuel quantity required from moment to moment during the engine acceleration or deceleration.

Conventional techniques heretofore proposed for solving this problem include methods in which the quantity of deposited fuel is estimated and the desired fuel injection quantity is determined on the basis of the estimated deposited fuel (e.g., a fuel injection quantity control method for fuel injection engines disclosed in Japanese Patent Publication No. 58-8238 by Toyota Jidosha Co., Ltd.). In this method, a basic width of the fuel injection pulse supplied to the injector is determined in accordance with the manifold pressure and the engine speed and the quantity of film mass in the intake manifold is estimated on the assumption that the fuel is injected for the duration of the pulse width. However, the actual quantity of fuel injected into the intake manifold is the quantity of fuel injected during the time that the injection valve or injector is opened for the duration of an actual fuel injection pulse width calculated in accordance with the fuel quantity carried over to the engine cylinder, the deposited fuel quantity, a feedback correction factor, etc., as well as the basic fuel injection pulse width. As a result, it is impossible to correctly estimate the actual quantity of film mass unless the method of estimating the quantity of film mass deposited in the intake manifold is such that the actually injected fuel quantity is fed back and a part of the injected fuel quantity is deposited on the intake manifold wall. For these reasons, the conventional estimating method cannot accurately estimate the quantity of film mass and therefore there is a disadvantage that the quantity of fuel supplied to the engine deviates from the required fuel quantity at the moment despite the fact that the fuel injection quantity also takes the quantity of film mass into consideration.

Also included among the conventional fuel injection quantity control methods of controlling the fuel injection quantity by estimating the quantity of film mass are methods in which the desired fuel injection quantity is determined by subtracting the quantity delivered to the cylinder or the carry-over quantity from the quantity of film mass and adding the deposited quantity on the manifold wall to the basic fuel injection quantity (e.g., Japanese Patent Publication No. 58-8238). In this case, of the quantity of fuel injected the quantity of fuel deposition on the manifold wall is of such a nature that it can be accurately determined only after the actual fuel injection quantity has been determined. While this conventional method determines the deposition quantity of fuel supposed to be deposited on the manifold wall on the basis of a basic fuel injection pulse width, there is a disadvantage that the fuel deposited on the intake manifold wall does not represent a part of the actually injected fuel quantity and therefore it is impossible to accurately determine the quantity of film mass (the quantity of fuel deposition).

SUMMARY OF THE INVENTION

It is a first object of the present invention to provide a control method for a fuel injection engine which controls the quantity of fuel injected in such a manner that the air-fuel ratio of the mixture supplied to each cylinder attains a desired value when the quantity of film mass deposited on the intake manifold wall, the deposition rate or the rate of the film mass deposited on the manifold wall to the injected fuel and the vaporization rate or the rate of vaporization of the film mass from the manifold wall have been calculated from various sensor data.

It is a second object of the invention to provide a method of accurately estimating the quantity of film mass deposited on the intake manifold wall of an engine so as to control the quantity of fuel injected such that the quantity of fuel supplied to the engine always coincides with the required fuel quantity.

To accomplish the first object, the quantity of injected fuel entering the cylinder of an engine without depositing on the intake manifold wall is added to the quantity of fuel entering the cylinder as a result of the vaporization of the deposited film mass and this fuel quantity is injected as the actual fuel supply to the cylinder to attain the desired air-fuel ratio in accordance with the mass of air flow to the engine. Also, to accomplish the second object, the calculated value of a carry-over fuel quantity delivered to the engine cylinder during the current cycle is subtracted from the intake manifold wall film mass fuel quantity estimated during the preceding cycle and then the value of an intake manifold wall fuel deposition per cycle calculated on the basis of the actual injection quantity per stroke of the engine injected at the latest moment during the preceding cycle is added to the remaining film mass fuel quantity.

BRIEF DESCRIPTION OF THE DRAWINGS

FIG. 4 is a flow chart of the ordinary computing processing and interrupt processing.

FIGS. 5A to 5C are time charts illustrating the time relationship between the strokes and the cycle periods.

DESCRIPTION OF THE PREFERRED EMBODIMENTS

Figure 1A:
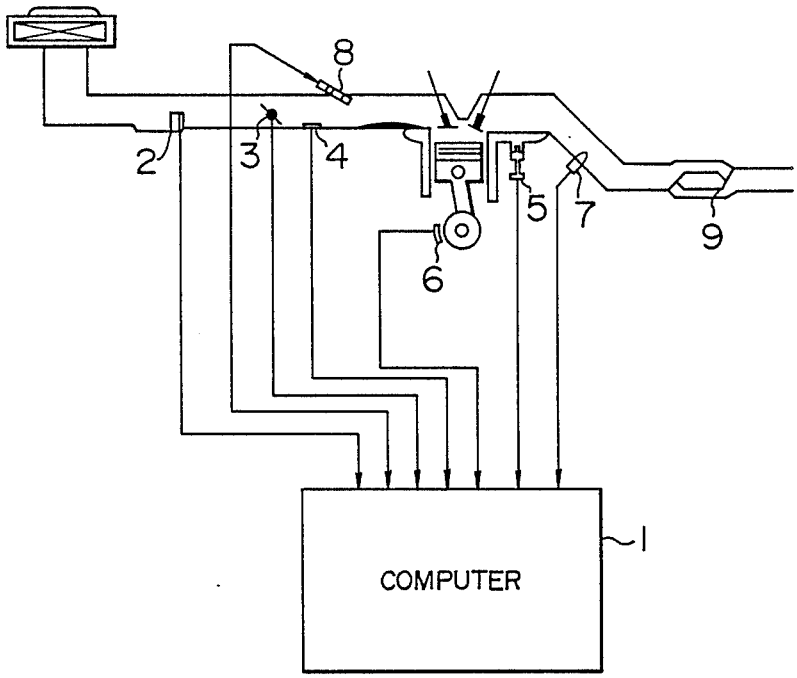
FIG. 1A is a schematic diagram showing the construction of a fuel injection control apparatus to which the present invention is applied.

An embodiment of a control method for a fuel injection engine according to the invention will now be described with reference to FIGS. 1A to 2. FIG. 1A illustrates a schematic diagram of a fuel injection control apparatus. In the Figure, the mass of air flow in the intake manifold of an engine is detected by a hot-wire air flow meter 2 and applied to a computer 1. The computer 1 receives the throttle position from a throttle position sensor 3, the intake manifold pressure from a manifold pressure sensor 4, the cooling water temperature from a water temperature sensor 5, the engine speed from a crank angle sensor 6 and the binary air-fuel ratio signal from an $O_2$ sensor 7. The computer 1 directs the desired fuel injection quantity to an injector 8.

Figure 1B:
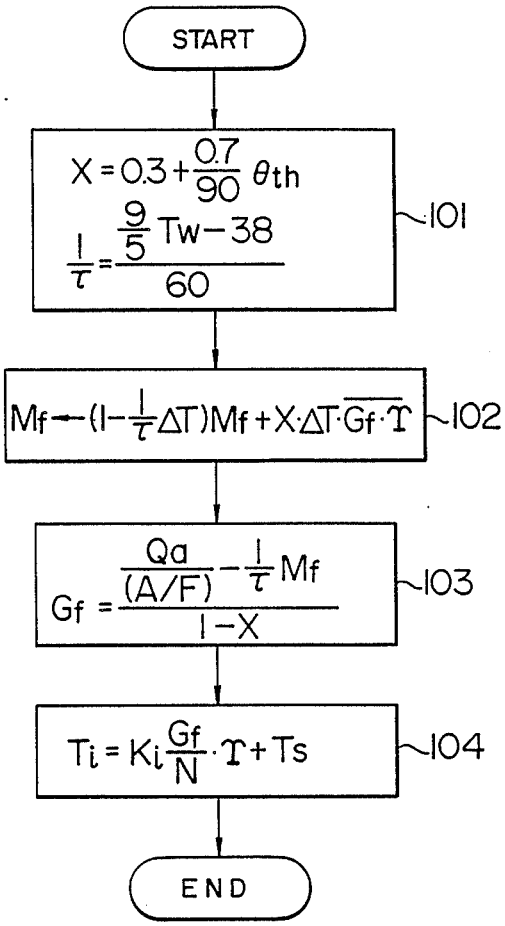
FIG. 1B is a flow chart showing the fuel injection control procedure of the computer 1.
Figure 2:
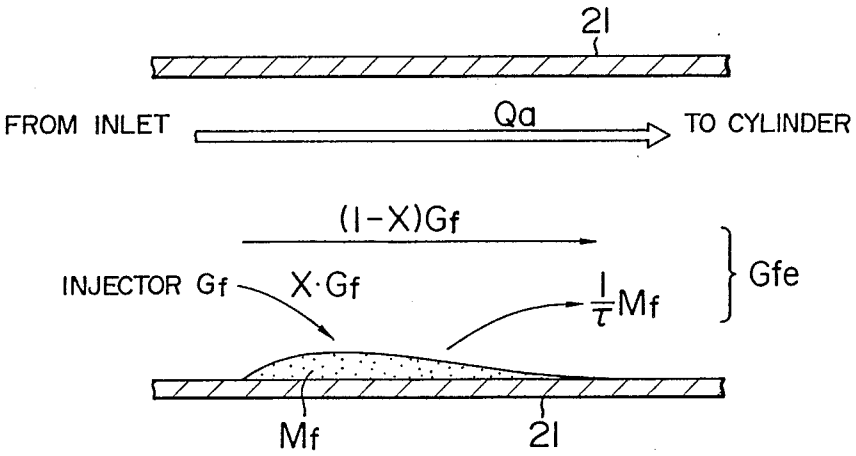
FIG. 2 is a diagram showing the behavior of the inducted air and fuel in the intake manifold.

As shown in FIG. 1B, at a step 101, the computer 1 calculates the rate of deposition of the fuel injection quantity on the intake manifold wall and the rate of vaporization of the film mass deposited on the intake manifold wall from the following equations (1) and (2), respectively, according to the inputted data. If the deposition rate is represented by X and the vaporization rate by $1/\tau$, the deposition rate X is simply given for example as a function of the throttle position $\theta$th as follows $$X = 0.3 + \frac{0.7}{90}\,\theta\text{th} \tag{1}$$

On the other hand, the vaporization rate $1/\tau$ is given as a function of the water temperature $T_w$ as follows $$\frac{1}{\tau} = \frac{\frac{9}{5}T_w - 38}{60} \tag{2}$$

Here, it is assumed so that $1/\tau = 0.026$ when $T_w \leqq 23°$ C.

Then, at a step 102, in accordance with the resulting deposition rate X and vaporization rate $1/\tau$, the current film mass quantity is calculated from the film mass quantity obtained during the preceding cycle and the actually injected fuel quantity as follows $$M_f \rightarrow \left(1 - \frac{1}{\tau}\Delta T\right)M_f + X \cdot \Delta T \cdot \overline{G_f \cdot Y} \tag{3}$$

where $\Delta T$ is the computing cycle period, $M_f$ is the film mass quantity, $G_f$ is the fuel injection quantity and $G_f Y$ is the actually injected fuel quantity in terms of the fuel quantity per unit time.

Then, at a step 103, the fuel injection quantity per unit time is determined in accordance with the deposition rate and the film mass quantity in the following manner. The fuel injection quantity of the engine must correspond to the intake air flow and therefore the desired value of the fuel quantity to be supplied to each cylinder is given as follows.

$$G_{fe}^* = \frac{Q_a}{(A/F)} \tag{4}$$

where $Q_a$ is the intake air flow, (A/F) is the desired air-fuel ratio and $G_{fe}^*$ is the desired value of the quantity of fuel injected into the engine cylinder. FIG. 2 shows the behavior within the intake manifold of the fuel quantity entering the engine cylinder. As shown in the Figure, if $G_f$ represents the injected fuel quantity, $X \cdot G_f$ represents the quantity of the fuel deposited on an intake manifold wall 21 and $(1-X)G_f$ represents the quantity of the fuel supplied to the cylinder without deposition. Also, $M_f/\tau$ represents the quantity of fuel supplied to the cylinder by the vaporization of the previously deposited fuel quantity (film mass quantity) on the intake manifold wall 21. As a result, if the quantity of fuel supplied to the cylinders is represented by $G_{fe}$, then the following equation holds $$G_{fe} = (1 - X)\,G_f + \frac{1}{\tau}M_f \tag{5}$$

If the value of $G_{fe}$ is equal to the fuel quantity $G_{fe}^*$ to be supplied to the cylinder, the desired air-fuel ratio will be attained. Thus, assuming that the equations (4) and (5) are equal, $$\frac{Q_a}{(A/F)} = (1 - X)\,G_f + \frac{1}{\tau}M_f \tag{6}$$

Then, it is only necessary to determine the fuel injection quantity $G_f$ such that the above equation holds. Thus, the following equation holds $$G_f = \frac{\frac{Q_a}{(A/F)} - \frac{1}{\tau}M_f}{1 - X} \tag{7}$$

The equation (7) is obtained as follows. The fuel quantity $Q_a/(A/F)$ to be supplied to the cylinder to attain the desired air-fuel ratio is obtained in accordance with the intake air flow $Q_a$ and the fuel quantity $M_f$ to be carried over to the cylinder is obtained in accordance with the vaporization rate $1/\tau$ and the film mass quantity $M_f$. The fuel quantity $M_f$ is subtracted from the fuel quantity $Q_a/(A/F)$ and the difference is divided by the non-deposition rate $(1-X)$ of the injection fuel to be supplied to the cylinder without deposition thereby determining the desired fuel quantity per unit time.

Since the value of $G_f$ obtained at the step 103 is the fuel injection quantity per unit time, it is then converted to a fuel injection pulse width per stroke of the engine at a step 104, as follows $$T_i = k_i \cdot \frac{G_f}{N} \cdot Y + T_s \tag{8}$$

where N is the engine speed, $k_i$ is a coefficient determined by the characteristics of the injector, Y is the correction factor fed back by the $O_2$ sensor signal and $T_s$ is a dead fuel injection time.

The fuel injection pulse width per stroke $T_i$ is renewed at intervals of the computing cycle and therefore the actual fuel injection takes place for the duration of the fuel injection pulse width $T_i$ existing at the time of arrival of an interrupt signal generated for every stroke. Therefore, as the fuel injection quantity data required for the computer to calculate the quantity of film mass during the next cycle, the actual fuel injection pulse width in terms of the following quantity corresponding to the fuel quantity per unit time is fed back $$\overline{G_f Y} \tag{9}$$

The expression (9) is used during the next computing cycle as shown by the equation (3).

Figure 3:
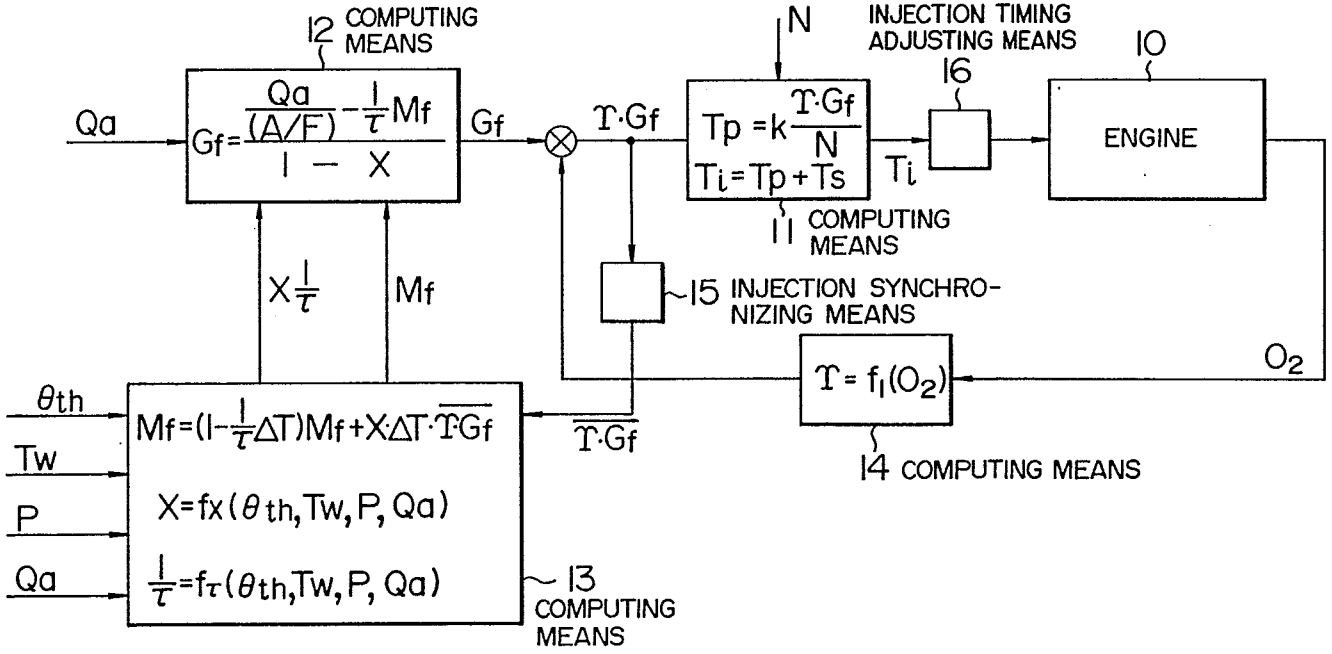
FIG. 3 is a block diagram of the fuel injection control system.

FIG. 3 illustrates a block diagram of the fuel injection control system in the computer 1 of FIG. 1A. In the Figure, a fuel injection quantity per unit time $G_f$ is calculated by computing means 12 in accordance with the film mass estimated by computing means 13 for estimating the film mass quantity $M_f$ deposited on the intake manifold wall and the mass of air flow. In response to the signal generated from the $O_2$ sensor 7, computing means 14 calculates an air-fuel ratio feedback correction factor $Y=f(O_2)$ aiming at a stoichiometric air fuel ratio. Computing means 11 calculates the quantity of fuel injected per stroke as shown by the following equation $$T_i = k\frac{Y \cdot G_f}{N} + T_s \tag{10}$$

where k is a coefficient which is used in the conversion to the fuel injection quantity per stroke and dependent on the injector characteristics and $T_s$ is a dead injection time.

The computing means 13 computes the quantity of film mass in the intake manifold as follows $$M_f \leftarrow \left(1 - \frac{1}{\tau}\Delta T\right)M_f + X \cdot \Delta T \cdot \overline{Y \cdot G_f} \tag{11}$$

Here, the right member $M_f$ represents the film mass quantity for the preceding cycle and the left member $M_f$ is the newly estimated film mass quantity. Also, $1/\tau$ represents the rate of vaporization of the film mass and X represents the rate of fuel deposition on the intake manifold wall to the injected fuel quantity (referred to as a deposition rate). Represented by $\Delta T$ is one cycle period of the computation by the blocks of FIG. 3. Thus, the following in the right member represents the quantity of fuel delivered to the cylinder by the vaporization of the film mass during one cycle period $$\frac{1}{\tau}\Delta T M_f \tag{12}$$

Also, of the quantity of fuel actually injected per unit time the quantity of fuel deposition during the cycle period is given by the second term of the right member in the equation (11) or the following expression $$X \cdot \Delta T \cdot \overline{YG_f} \tag{13}$$

While a description will be made later of $\overline{Y \cdot G_f}$ in consideration of the time relationship between the time per stroke and the cycle period of computation, the fuel injection quantity per unit time $Y \cdot G_f$ resulting from the integration of the feedback correction factor Y represents the quantity of fuel injected per unit time which is renewed in response to the application of a stroke start signal from the crank angle sensor. While the deposition rate X and the vaporization rate $1/\tau$ ($\tau$ is a vaporization time constant) are obtained by experiments in accordance with the throttle position $\theta$th, the water temperature $T_w$, the manifold pressure P, the mass air flow $Q_a$, etc., in this embodiment the deposition rate X is given as a function of the throttle position for purposes of simplicity, as follows $$X = 0.3 + \frac{0.7}{90}\theta\text{th} \tag{14}$$

Also, the vaporization rate is given as a function of the water temperature as follows $$\frac{1}{\tau} = \frac{\frac{9}{5}T_w - 38}{60} \tag{15}$$

Here, it is assumed that $1/\tau=0.0266$ when $T_w \leqq 23°$ C.

As described hereinabove, a feature of the construction of the control system resides, as will also be seen from FIG. 3, in the fact that the feedback loop for feeding back the correction factor Y in response to the $O_2$ sensor signal and the loop of the fuel injection quantity $Y \cdot G_f$ for calculating the deposited quantity or the deposited part of the injected fuel overlap doubly.

Next, the timing of the injection per stroke and the timing of the computing cycle will be described. The computational operations shown in FIG. 3 are performed at intervals of a given period T and the injection pulse width is renewed by injection timing adjusting means 16 of FIG. 3 at a step 31 of FIG. 4 for every period. The actual injection is initiated by an interrupt signal INT generated for every stroke. As a result, the fuel is actually injected for the duration of the most lately calculated injection pulse width $T_i$ as shown in FIGS. 5A to 5C. FIGS. 5A to 5C respectively show interrupt signals each generated for every stroke, injection pulse widths and calculated $Y \cdot G_f$ with the lapse of time. In accordance with the embodiment, when an interrupt signal is applied, the timely existing $Y \cdot G_f$ is stored in a $\overline{Y \cdot G_f}$ memory. This operation is performed by injection synchronizing means 15 of FIG. 3 and its timing corresponds to the application of the interrupt signal as shown at a step 32 of FIG. 4. By performing these operations, the actually injected fuel quantity is fed back and used for the accurate estimation of the quantity of film mass.

In accordance with the present invention, the occurrence of lean spikes during the engine acceleration and the occurrence of rich spikes during the engine deceleration are eliminated as compared with the conventional method in which a basic fuel injection quantity is determined in accordance with the flow of intake air. This has the effect of improving the engine performance during the acceleration and ensuring effective removal of the harmful gases during the deceleration. Thus, it is possible to reduce the amount of the three-way catalyst by this method making it also effective economically. Further, while it has been necessary in the past to prepare various memory maps for providing acceleration and deceleration corrections on the basis of changes in the throttle position, etc., and search for the corresponding map values, in accordance with the present invention the desired acceleration and deceleration corrections can be provided by matching only the deposition rate of the fuel injection and the vaporization rate of the film mass in accordance with the acceleration and deceleration air-fuel ratios and thus the invention has the effect of providing more efficient manufacturing steps.

Further, in accordance with the invention, by virtue of the fact that the quantity of the film mass deposited on the intake manifold wall is estimated by newly estimating the film mass quantity by using the actually injected fuel quantity, it is possible to estimate an accurate film mass quantity closer to the actual film mass quantity. By using the method which determines the desired fuel injection quantity in consideration of such estimated film mass, the air-fuel ratio of the mixture supplied to the engine can be controlled at around the stoichiometric air-fuel ratio even during the engine acceleration and deceleration. Thus, the invention has the effect of improving the exhaust gas purification and the engine performance.

What is claimed is:

1. A method for controlling fuel injection into an engine comprising the steps of:

(a) determining a current fuel injection quantity $G_f$ per stroke of said engine in a current computing cycle in accordance with the following equation:

$$G_f = \frac{Q_a/(A/F) - \frac{1}{\tau} M_f}{1 - X}$$

by calculating a deposition rate X of injected fuel on an intake manifold wall of said engine and vaporization rate $1/\tau$ of a deposited film mass, calculating a current film mass quantity $M_f$ from said calculated X and $1/\tau$ and a fuel injection quantity $G_f$ in a preceding injection and calculating a desired fuel quantity $G_a/(A/F)$ to be supplied to each cylinder of said engine from an intake air flow $Q_a$ and a desired air-fuel ratio A/F;

(b) calculating an air-fuel ratio feedback correction factor Y aiming at a stoichiometric air-fuel ratio based on a signal generated by an $O_2$ sensor in said current computing cycle;

(c) injecting an actual quantity of fuel corresponding to $G_f Y$ at the present time in said current computing cycle including converting said current fuel injection quantity $G_f$ into a fuel injection pulse width per stroke of said engine based on the following equation:

wherein N is the engine speed, $k_i$ is a coefficient determined by the characteristics of an injector, Y is the air-fuel ratio feedback correction factor, and $T_S$ is a dead fuel injection time;

$$T_i = k_i \cdot \frac{G_f}{N} \cdot \gamma + T_s$$

(d) determining a film mass quantity $M2_f$ at a predetermined time in the next computing cycle based on the film mass quantity $M_{fi}$ calculated in said step (a) in said current computing cycle and said actual fuel injection quantity based on the following equation:

$$M_f = \left(1 - \frac{1}{\tau} \Delta T\right) M_{fi} + X \cdot \Delta T \cdot \overline{\gamma \cdot G_f}$$

where ΔT is the length of one cycle period; and (e) repeating said steps (a), (b), (c), and (d) sequentially for successive computing cycles.

2. A method according to claim 1, wherein step (d) of determining the film mass quantity includes the steps of: p1 subtracting from said current film mass quantity calculated in said step (a) a calculated value of a carry-over fuel quantity delivered to an engine cylinder during a time interval from the present time until said predetermined time; and adding to a resultant value of said subtracting step a calculated value of a deposition fuel quantity which is deposited on an intake manifold wall out of said actual fuel injection quantity during a time interval from the present time until said predetermined time.

3. A method according to claim 1, wherein said actual fuel injection quantity is a fuel quantity which is injected at a time most close in time to a time point preceding said predetermined time by one computing cycle.

4. An apparatus for controlling fuel injection into an engine comprising:

(a) means for determining a current fuel injection quantity $G_f$ per stroke of said engine in a current computing cycle in accordance with the following equation:

$$G_f = \frac{Q_a/(A/F) - \frac{1}{\tau} M_f}{1 - X}$$

said current fuel injection quantity determining means including means for calculating a deposition rate X of injected fuel on an intake manifold wall of said engine and a vaporization rate $1/\tau$ of a deposited film mass, means for calculating a current film mass quantity $M_f$ from said calculated X and $1/\tau$ and a fuel injection quantity $G_f$ in a preceding injection, and means for calculating a desired fuel quantity $Q_a/(A/F)$ to be supplied to each cylinder of said engine from an intake air flow $Q_a$ and a desired air-fuel ratio A/F;

(b) means for calculating an air-fuel ratio feedback correction factor Y aiming at a stoichiometric air-fuel ratio based on a signal generated by an $O_2$ sensor in said current computing cycle;

(c) means for injecting an actual quantity of fuel corresponding to $G_f Y$ at the present time in said current computing cycle including means for converting said current fuel injection quantity $G_f$ into a fuel injection pulse width per stroke of said engine based on the following equation:

$$T_i = k_i \cdot \frac{G_f}{N} \cdot \gamma + T_s$$

wherein N is the engine speed, $k_i$ is a coefficient determined by the characteristics of an injector, Y is the air-fuel ratio feedback correction factor, and $T_S$ is a dead fuel injection time;

(d) means for determining a film mass quantity $M_f$ at a predetermined time in the next computing cycle based on the film mass quantity $M_{fi}$ at the present time calculated by said current fuel injection quantity determining means (a) and said actual fuel injection quantity based on the following equation:

$$M_f = \left(1 - \frac{1}{\tau} \Delta T\right) M_{fi} + X \cdot \Delta T \cdot \overline{\gamma \cdot G_f}$$

where ΔT is the length of one cycle period; and wherein said current fuel injection quantity determining means, said air-fuel ratio feedback correction factor calculating means, said injecting means, and said film mass

5. A apparatus according to claim 4, wherein said means for determining the film mass quantity includes:

means for subtracting from said current film mass quantity calculated by said current fuel injection quantity determining means a calculated value of a carry-over fuel quantity delivered to an engine cylinder during a time interval from the present time until said predetermined time; and means for adding to a resultant value obtained by said subtracting means a calculated value of a deposition fuel quantity which is deposited on an intake manifold wall out of said actual fuel injection quantity during a time interval from the present time until said predetermined time.

6. A method for controlling fuel injection into an engine comprising the steps of:

(a) determining, in a current computing cycle, a current fuel injection quantity, so that the summation of a first fuel quantity delivered to each cylinder of said engine without being deposited on an intake manifold wall of said engine and a second fuel quantity vaporized from a film mass quantity deposited on said wall is equal or nearly equal to a desired fuel quantity to be supplied to said cylinder;

(b) calculating a fuel injection quantity feedback correction factor Y corresponding to a desired air-fuel ratio in said current computing cycle;

(c) injecting an actual fuel quantity corrected by said factor Y; and (d) determining a film mass quantity used in the (d) determining a film mass quantity used in the following computing cycle based on the film mass quantity in said current computing cycle and said actual fuel injection quantity $\overline{(Y\ G_f)}$.

7. A method according to claim 6, wherein said desired fuel quantity and said second fuel quantity are corrected by said correction factor Y.

8. A method according to claim 6, wherein said desired fuel quantity is determined from an intake air flow and a desired air-fuel ratio.

9. A method according to claim 6, wherein said step (c) of injecting an actual fuel injection quantity includes a step of converting said current fuel injection quantity into a fuel injection pulse width.

10. A method according to claim 9, wherein said conversion of said current fuel injection quantity is carried out based on the following equation:

$$T_i = k_i \cdot \frac{G_f}{N} \cdot T + T_s$$

wherein N is the engine speed, $k_i$ is a coefficient determined by the characteristics of an injector, Y is the fuel injection quantity feedback correction factor, and $T_s$ is a dead fuel injection time.

11. A method according to claim 6, wherein said step (d) of determining the film mass quantity includes the steps of:

subtracting from said current film mass quantity in said step (a) a calculated value of a carry-over fuel quantity adding to a resultant value of said subtracting step a calculating value of a deposition fuel quantity which is deposited on an intake manifold wall out of said actual fuel injection quantity during a time interval from the present time until said predetermined time.

12. A method for controlling fuel injection into an engine comprising the steps of:

(a) determining, in a current computing cycle, a current fuel injection quantity ($G_f$), according to intake air flow ($Q_a$), desired air/fuel ratio (A/F), deposition rate (X) as well as vaporization rate ($1/\tau$), and a film mass quantity ($M_f$) calculated from X, $1/\tau$ and the fuel injection quantity ($Y \cdot G_f$) at the preceding injection, so that the summation of first fuel quantity delivered to each cylinder of said engine and second fuel quantity vaporized from a film mass quantity deposited on said wall is equal or nearly equal to a desired fuel quantity to be supplied to said cylinder;

(b) determining a fuel injection quantity feedback correction factor (Y) corresponding to a desired air-fuel ratio based on a signal generated by an $O_2$ sensor in said current computing cycle;

(c) calculating an actual fuel injection quantity ($Y \cdot G_f$) by multiplying said correction factor Y and said current fuel injection quantity $G_f$;

(d) calculating a fuel injection time ($T_i$) according to $Y \cdot G_f$ and engine speed (N);

(e) updating said fuel injection time $T_i$ to a latest calculated value in a current computing cycle;

(f) injecting a fuel injection quantity $Y \cdot G_f$ during at latest time of said fuel injection time $T_i$ when an injection pulse is generated;

(g) storing in said memory a value $Y \cdot G_f$ as said fuel injection quantity $Y \cdot G_f$ at the current injection;

(h) determining (X, $1/\tau$) and $M_f$ which are used for determining $G_f$, in said current computing cycle, according to throttle angle ($\theta t_h$), water temperature ($T_w$), back pressure (P) and intake air flow ($Q_a$), and according to the calculated (X, $1/\tau$) and $\overline{Y \cdot G_f}$ stored in said memory at the preceding injection.

* * * * *